US008008593B2

(12) United States Patent
Inagaki

(10) Patent No.: US 8,008,593 B2
(45) Date of Patent: Aug. 30, 2011

(54) SWITCH FOR SEESAW KEY

(75) Inventor: Shuji Inagaki, Toride (JP)

(73) Assignee: Covac Co., Ltd., Saitama (JP)

( * ) Notice: Subject to any disclaimer, the term of this patent is extended or adjusted under 35 U.S.C. 154(b) by 147 days.

(21) Appl. No.: 12/305,415

(22) PCT Filed: Jan. 23, 2007

(86) PCT No.: PCT/JP2007/050946
§ 371 (c)(1),
(2), (4) Date: Dec. 18, 2008

(87) PCT Pub. No.: WO2007/148446
PCT Pub. Date: Dec. 27, 2007

(65) Prior Publication Data

US 2009/0277765 A1 Nov. 12, 2009

(30) Foreign Application Priority Data

Jun. 22, 2006 (JP) ..... 2006-172205

(51) Int. Cl.
*H01H 1/10* (2006.01)

(52) U.S. Cl. ..... 200/517; 200/513; 200/512; 200/343

(58) Field of Classification Search ..... 200/512–517, 200/296, 341, 343, 344
See application file for complete search history.

(56) References Cited

U.S. PATENT DOCUMENTS

| | | | | |
|---|---|---|---|---|
| 4,492,829 | A * | 1/1985 | Rodrique | 200/5 A |
| 4,604,509 | A * | 8/1986 | Clancy et al. | 200/513 |
| 4,771,139 | A * | 9/1988 | DeSmet | 200/5 A |
| 5,228,561 | A * | 7/1993 | Schroeder et al. | 200/517 |
| 5,278,374 | A * | 1/1994 | Takagi et al. | 200/513 |
| 5,564,560 | A * | 10/1996 | Minelli et al. | 200/516 |
| 6,201,202 | B1 * | 3/2001 | Katagiri | 200/513 |
| 6,423,171 | B1 * | 7/2002 | Yang | 156/245 |
| 6,621,017 | B2 * | 9/2003 | Shibutani et al. | 200/5 A |
| 6,940,030 | B2 * | 9/2005 | Takeda et al. | 200/343 |
| 7,060,920 | B2 * | 6/2006 | Serizawa et al. | 200/200 |
| 7,285,741 | B2 * | 10/2007 | Kato | 200/513 |
| 7,442,894 | B2 * | 10/2008 | Villain et al. | 200/344 |
| 2002/0027062 | A1 | 3/2002 | Shibutani et al. | |

FOREIGN PATENT DOCUMENTS

| | | |
|---|---|---|
| JP | 63-60234 | 4/1988 |
| JP | 63-112724 | 7/1988 |
| JP | 4-58924 | 5/1992 |
| JP | 8-22738 | 1/1996 |
| JP | 2002-63830 | 2/2002 |
| JP | 2005-005139 | 1/2005 |

* cited by examiner

*Primary Examiner* — Michael A Friedhofer
(74) *Attorney, Agent, or Firm* — Young & Thompson

(57) ABSTRACT

A switch comprises a key top to be pushed down; an operation knob pushed down by the key top to rotate around a pivot point, having a working portion; and a contact rubber switch pushed down by the working portion of the operation knob. The rubber switch is provided with a push-button portion having an upper surface pushed down by the working portion of the operation knob and an under surface formed with a movable contact; and a skirt portion extending obliquely downward from an edge of the push-button portion. The skirt portion has a thinner portion on the side of the pivot point of the operation knob and a thicker portion on the opposite side of the pivot point. The push-button portion has an upper surface inclined upward toward the side of the pivot point. The switch has advantages such as simple structure, reliable conduction, and excellent click feeling.

6 Claims, 5 Drawing Sheets

SWITCH FOR SEESAW KEY

FIELD OF THE INVENTION

The present invention relates to a switch using a contact rubber switch operated by a seesaw-key which is used for operating home electric appliances, mobile phones and in-vehicle units.

BACKGROUND OF THE INVENTION

Some switches mounted on home electric appliances and in-vehicle units use a contact rubber switch. The switch of this type has a key top or an operation knob operated by a user and the rubber switch which is pushed down by the key top and the operation knob. When the key top is pushed down by a finger to push down the rubber switch, a movable contact formed on an under surface of the rubber switch contacts a fixed contact formed on a circuit board, providing conduction between the contacts.

Some of these switches are constructed such that the operation knob is rotated around a pivot point. In the switch of this type, when the key top is being pushed down to rotate the operation knob, the operation knob contacts the contact rubber switch in a tilted state. In this instance, the movable contact sometimes goes down without remaining in a horizontal posture, causing insufficient conduction between the contacts. In some contact rubber switches, the movable contact provides the conduction by deformation of the rubber during the pushing operation. In this operation, it is preferable to give a clear clicking feeling which teaches completion of the pushing operation to a user.

In view of the points, various types of improved seesaw switches have been proposed. One of the seesaw switches has an inclined movable contact surface which becomes parallel to a fixed contact when the movable contact is pushed down (referring to Patent literature 1). Or, another seesaw switch has a projecting contact which contacts the operation knob with a small contact area (referring to Patent literature 2). And, still another seesaw switch is proposed, which has a pusher pushed down by an operation knob to press a movable contact formed on a rubber contact switch, in which the rubber contact switch is provided with an elastic member with which the operation knob comes in contact before the operation knob contacts the pusher (referring to Patent literature 3). However, these switches have problems in which a sufficient click feeling of the switch can not generated when pushed down and they needs increased numbers of parts causing a complex structure.

Patent literature 1: Unexamined Japanese Utility Model Publication Sho63-60234,

Patent literature 2: Unexamined Japanese Utility Model Publication Sho63-112724 and Patent literature 2: Japanese Patent Publication 2005-5139.

SUMMARY OF INVENTION

An object of the present invention is to provide a switch which has advantages such as simple structure, reliable conduction, or excellent click feeling when operated.

A switch according to the present invention is a switch which is pushed down so as to conduct a fixed contact formed on a circuit board and comprises: a key top to be pushed down; an operation knob pushed down by the key top to rotate around a pivot point, having a working portion; and a contact rubber switch pushed down by the working portion of the operation knob; wherein the rubber switch is provided with a push-button portion having an upper surface pushed down by the working portion of the operation knob and an under surface formed with a movable contact; and a skirt portion extending obliquely downward from an edge of the push-button portion, in which the skirt portion has a thinner portion on the side of the pivot point of the operation knob and a thicker portion on the opposite side of the pivot point of the operation knob and the push-button portion has an upper surface inclined upward toward the side of the pivot point of the operation knob.

In the generally used switches constructed such that the operation knob is rotated around a pivot point, the operation knob contacts the push-button portion in a tilted state during most of the rotating operation. Accordingly, the movable contact does not go down straight, causing insufficient conduction. So, in order to solve the problem, in the present invention, the skirt portion is constructed so as to have a thinner portion on the side of the pivot point of the operation knob and a thicker portion on the opposite side of the pivot point of the operation knob. Furthermore, the upper surface of the push-button portion inclines upward toward the side of the pivot point of the operation knob. As a result, it becomes possible to contact the movable contact with the fixed contact with a parallel posture to cause sufficient conduction, described later referring to as FIG. 3 in detail.

Preferably, the working portion of the operation knob contacts the edge of the push-button portion of the rubber switch, on the side of the pivot point of the operation knob, to deform the skirt portion on the side of the pivot point at the initial step of the push down operation, and then the working portion contacts the edge of the push-button portion of the rubber switch, on the opposite side of the pivot point, to be pushed down and to deform the skirt portion on the opposite side of the pivot point.

In this case, at the initial step (the preload step), since the skirt portion on the side of the pivot point is deformed such that the push-button portion tilts downward toward the side of the pivot point, the upper portion of the push-button portion is made to come in contact with the working portion of the operation knob evenly.

In the present invention, the push-button portion of the contact rubber switch may have a central portion having a surface inclined upward toward the side of the pivot point; a peripheral portion surrounding the central portion other than an edge on the pivot point side; and a slit having a thin base separating the central portion from the peripheral portion, in which the working portion of the operation knob contacts only the upper surface of the central portion and does not contact the peripheral portion when comes in contact with the push-button portion of the contact rubber switch.

In this case, the central portion of the push-button portion is easy to rotate with respect to the base of the slit when the push-button portion is pushed down by the working portion of the operation knob whereby it becomes possible to contact the upper surfaces of the central portion and the peripheral portion with the working portion of the operation knob.

In the present invention, the contact rubber switch may be operated in such a manner that the movable contact tilts downward toward the side of the pivot point when the key top is being applied with preload; an angle of the movable contact becomes small gradually during a push down operation of the key top; and the movable contact comes contact with the fixed contact with substantially a parallel posture at the final step of the push down operation.

Preferably, the thicker skirt portion on the opposite side of the pivot point of the operation knob is suddenly deformed at the final step of the push down operation to cause a click feeling teaching a completion of the push down operation to the user.

In this case, at the final step of the push down operation, the key top is applied with pressure produced by the sudden deformation of the thicker skirt portion thereby to generate a clear click feeling teaching completion of the push down operation to the user.

EFFECT OF THE INVENTION

As described above, according to the switch of the present invention, it becomes possible to contact the movable contact formed on the push-button portion in surface with the fixed contact formed on the circuit board in a parallel posture. Furthermore, as compared with the generally used switches, only the contact rubber switch is modified and number of parts does not increase. So, a switch with stably operation ability and simple structure can be provided.

DETAILED DESCRIPTION OF EMBODIMENT OF THE INVENTION

Hereinafter, preferred embodiments of the present invention will be described in detail with reference to the accompanying drawings.

FIG. 1 is a side view showing a switch according to the first embodiment of the present invention.

FIG. 2 are views showing a structure of a contact rubber switch included in the switch of FIG. 1, FIG. 2(A) is a side view and FIG. 2(B) is a plain view.

FIG. 3 are side views showing operating state of the switch of FIG. 1.

As shown in FIG. 1, the switch 1 is mounted on a circuit board 2 and is pushed down so as to conduct a pair of contact points (not shown) of a fixed contact 3 formed on the board 2. The switch 1 is provided with a key top 5 pushed down by an operator's finger, an operation knob 6 pushed down with the key top 5 and a contact rubber switch 10 pushed down by the operation knob 6. The circuit board 2 is, for example, a substrate made by fiberglass sheet core and epoxy resin. On the circuit board 2, a circuit is formed, which includes the contact 3 exposed on the surface of the board 2. The fixed contact 3 is formed by printing using a conductive ink, for example.

The key top 5 has a cylindrical body 5*a*, a flange portion 5*b* extending outward from an under surface of the body 5*a* and a pusher rod 5*c* protruding vertically from a center of the under surface of the body 5*a*. The key top 5 is slidably mounted upward and downward to a case 4 covering the board 2. Specifically, the case 4 is formed with a circular opening 4*a* which allows passing of the body 5*a* of the key top 5. On a peripheral wall of the opening 4*a*, a peripheral recess 4*b* having a suitable height is formed, into which the flange portion 5*b* is stored. The flange portion 5*b* slides in the recess 4*b* upward and downward to guide the key top 5 in upward and downward directions (in a stroke direction).

Under the key top 5 the operation knob 6 is arranged. The operation knob 6 is a flat plate shaped member and is rotatably attached to the case 4 at the proximal portion 6*a*. The pusher rod 5*c* of the key top 5 comes in contact with the distal portion (working portion) 6*b* of the operation knob 60*n* pushing down the key top 5, the distal portion 6*b* of the operation knob 6 is pushed down by the pusher rod 5*c* to rotate the operation knob 5 around a pivot point P. As described later, the pivot point P is positioned lower than the highest point of the contact rubber switch 10. In this example, the operation knob 6 rotates from a slightly upward tilted state to a slightly downward tilted state with respect to a level line.

Under the distal portion (working portion) 6*b* of the operation knob 6, the contact rubber switch 10 is disposed. The rubber switch 10 has a supporting portion 11 mounted on the board 2, a push-button portion 12 pushed down by the working portion 6*b* of the operation knob 6 at the upper surface thereof and a skirt portion 13 extending obliquely downward from a peripheral edge of the push-button portion 12 to the supporting portion 11. On an under surface of the push-button portion 12, a movable contact 14 is formed. The movable contact 14 is positioned above the fixed contact 3 formed on the board 2. When the push-button portion 12 of the rubber switch 10 is pushed down by the working portion 6*b* of the operation knob 6, the push-button portion 12 moves downward to cause contact of the movable contact 14 with the fixed contact 3, providing conduction of the pair of contacts of the fixed contact 3.

Referring to FIG. 2, the structure of the contact rubber switch 10 will be described.

As described above, the contact rubber switch 10 has the supporting portion 11 mounted on the board 2, the push-button portion 12 pushed down by the working portion 6*b* of the operation knob 6 at the upper surface thereof and the skirt portion 13 extending obliquely downward from the peripheral edge of the pusher button portion 12 to the supporting portion 11. The portions are formed integrally using elastic rubber such as silicone rubber.

The supporting portion 11 is mounted on the surface of the board 2. The supporting portion 11 is formed with an opening 11*a* for exposing the fixed contact 3 formed on the board 2.

The push-button portion 12 is a substantially rectangular solid shaped member and has a main body 12*a* positioned on the side of the pivot point P of the operation knob 6 (on the pivot point side, on the right hand side in the figure) and a secondary body 12*b* positioned on the opposite side of the pivot point P (on the opposite side of the pivot point). The main body 12*a* has an upper surface 12*c* inclined upward toward the side of the pivot point P; the secondary body 12*b* has a substantially horizontal flat upper surface 12*d*. In this example, the inclined upper surface 12*c* makes up about two thirds of a total area of the upper surface of the push-button portion 12 and the flat upper surface 12*d* makes up about one third of the total area. The highest point of the upper surface of the push-button portion 12 (an edge 12*e* on the pivot point side) is positioned slightly higher than the pivot point P of the operation knob 6 in a free state in which the rubber switch 10 is not pushed down.

From an under surface of the main body 12*a*, a cylindrical projection 12*g* projects downward. The projection 12*g* has a substantially flat under surface (in substantially parallel to the fixed contact 3) on which the movable contact 14 is formed. The movable contact 14 is formed by gold plating or applying a conductive material such as metal and carbon on the under surface of the projection 12*g*, for example. A center of the movable contact 14 is positioned on an approximate center of the inclined upper surface 12*c*.

An under surface of the secondary body 12*b* is positioned higher than the under surface of the main body 12*a* (the movable contact 14).

The skirt portion 13 extends from the peripheral edge of the push-button portion 12 obliquely downward and outward toward the edge of the opening 11*a* of the supporting portion 11. A skirt portion 13*a* extending from the edge on the opposite side of the pivot point, one of four edges around the push-button portion 12, has a thickness thicker than that of the other skirt portions 13*b*, 13*c* and 13*d* extending from the other three edges.

Furthermore, as shown in FIG. 2A, the skirt portions 13*c* on the three edges other than the edge on the opposite side of the pivot point extend from the side surface of the main body 12*a* obliquely downward. On the contrary, the skirt portion 13*a* on the edge on the opposite side of the pivot point extends from the peripheral edge of the under surface of the secondary body 12*b* obliquely downward.

Around the skirt portions 13*a*, 13*b* and 13*d* other than the skirt portion 13*c* on the side of the pivot point of the operation knob 6, a slit 13*e* is formed so as to keep the supporting portion 11 without influence of the deformation force of the skirt portion 13 when the push-button portion 12 is pushed down. When the slit 13*e* is not formed, the supporting portion 11 may be applied with the deformation force thereby to be shifted. And, when the slit 13*e* is formed, since the slit 13*e* disperses the push down force, a click feeling may be affected. Depending on variation of products, the slit 13*e* may not be formed.

In a free state of the operation knob 6, indicated by an image line in FIG. 2A, (in a state in which the operation knob 6 contacts the upper surface of the contact rubber switch 10 and the contact rubber switch 10 is applied with the operation knob's own weight only), the under surface of the working portion 6*b* of the knob 6 contacts the upper surface of the push-button portion 12, specifically the under surface of the working portion 6*b* of the operation knob 6 contacts the edge 12*e* on the side of the pivot point only and does not contact the edge 12*f* on the opposite side of the pivot point. Since the pivot point P of the operation knob 6 is positioned slightly lower than the highest point (the edge 12*e*) of the upper surface of the push-button portion 12, the operation knob 6 contacts the push-button portion 12 in a slightly upward tilted state from the pivot point P.

Referring to FIG. 3, a switching operation of the switch will be described.

As shown in FIG. 3A, in a state in which the rubber switch 10 is assembled in the case 4, the flange portion 5*b* of the key top 5 abuts against the uppermost wall of the recess 4*b* of the case 4. The pusher rod 5*c* of the key top 5 contacts the working portion 6*b* of the operation knob 6 over an approximate center of the upper surface 12*c* of the main body 12*a* of the push-button portion 12 (an approximate center of the movable contact 14) And, the operation knob 6 rotates into a substantially horizontal posture and thus the push-button portion 12 is applied with load (preload). Applying the preload to the push-button portion 12 prevents backlash of the push-button portion 12. Conversely, a repulsive force produced by the rubber switch 10 applied with the load pushes the key top 5 up and the push-up force is suppressed by the flange portion 5*b*.

When the push-button portion 12 is pushed down by the operation knob 6, the skirt portion 13*c* on the pivot point side is deformed as bends outward because of its thin thickness and thus easy-deformable property. On the contrary, the skirt portion 13*a* on the opposite side of the pivot point is hardly deformed because of its thickness and thus less-deformable property. Accordingly, the push-button portion 12 rotates around the edge 12*e* on the pivot point side clockwise in the figure and then comes in contact with the operation knob 6 at the edge 12*f* on the opposite side of the pivot point. And, there is a space between a boundary portion of the inclined upper surface 12*c* and the flat upper surface 12*d* of the push-button portion 12, and the under surface of the operation knob 6. The movable contact 14 formed on the under surface of the push-button portion 12 tilts downward toward the side of the pivot point with respect to a level state shown in FIG. 2A (a state parallel to the fixed contact 3).

As shown in FIG. 3B, when the key top 5 is pushed down to push down the push-button portion 12 by the operation knob 6, the operation knob 6 rotates into a state tilted slightly downward from the pivot point (downward with respect to a level line).

Then, the skirt portion 13*b* on the pivot point side, having a thinner thickness and thus easy-deformable property, is deformed as bends further outward. At the same time, the skirt portion 13*a* on the opposite side of the pivot point, having a thicker thickness than the skirt portion 13*b* on the pivot point side and thus less-deformable property, is also deformed as bends outward slightly. And, the push-button portion 12 is deformed elastically so that the inclined upper surface 12*c* and the flat upper surface 12*d* of the push-button portion 12 contacts in surface with the under surface of the operation knob 6. And, the movable contact 14 still tilts downward toward the side of the pivot point; however, an angle of the tilt to a level line becomes smaller compared with the state shown in FIG. 2A.

Finally, as shown in FIG. 3C, the key top 5 is pushed down until the flange portion 5*b* abuts against the undermost wall of the recess 4*b* of the case 4 to push down the push-button portion 12 by the operation knob 6. The operation knob 6 rotates into a state tilted further downward compared with the state shown in FIG. 3B (further downward with respect to a level line).

As a result, the less-deformable skirt portion 13*a* on the opposite side of the pivot point can not sustain the push-down force to be deformed suddenly. However, since the skirt portion 13*a* on the opposite side of the pivot point has a thicker thickness and also extends obliquely downward from the under surface of the secondary body 12*b* of the push-button portion 12, it is not bent outward so much. On the contrary, the easy-deformable skirt portion 13*b* on the pivot point side bends outward to be deformed further. And, the push-button portion 12 is pushed down while moving inward (in a direction of the pivot point P). Then, an angle of the movable contact 14 with respect to a level line becomes almost zero resulting in that the movable contact 14 parallel contacts in surface with the fixed contact 3.

As described above, since the movable contact 14 formed on the push-button portion 12 contacts in surface with the fixed contact 3 formed on the circuit board 2, contact failure between the contacts will not occur. And, at the final step shown in FIG. 3C, the key top 5 is applied with a pressure produced by the suddenly deformation of the thick skirt portion 13*a*, providing a clear click sensation to the user.

When the key top 5 is released from the pressure applied thereto, the skirt portion 13 returns to its original shape by its elasticity. And, the operation knob 6 is pushed up by the push-button portion 12 until the flange portion 5*b* abuts against the uppermost wall of the recess 4*b* of the case 4.

FIG. 4 are views showing a contact rubber switch included in a switch according to the second embodiment of the present invention, FIG. 4A is a side view and FIG. 4B is a plain view.

FIG. 5 are views showing operating state of the switch of FIG. 4

The switch 1' has the same structure as the switch 1 of FIG. 1 except for a structure of a push-button portion 22. In this embodiment, the push-button portion 22 has a round hill-shaped central portion 22*a* and a peripheral portion 22*b* separated by a slit 22*c* from the central portion 22*a*. In FIGS. 4 and 5, the parts having the same structure and function as the parts of the switch 1 of FIG. 1 are indicated with the same number as FIG. 1 and will not be described.

The central portion 22*a*, corresponding to the main body 12*a* of the push-button portion 12 of FIG. 1, has an upper surface 22*d* inclined upward toward the side of the pivot point P. From an under surface of the central portion 22*a*, a cylindrical projection 22*f* projects downward. The projection 22*f* has a substantially flat under surface (in substantially parallel to the fixed contact 3) on which the movable contact 14 is formed.

The peripheral portion 22*b*, corresponding to the secondary body 12*b* of the push-button portion 12 of FIG. 1, surrounds the peripheral edge of the central portion 22*a* other than the edge on the pivot point side. The peripheral portion 22*b* has a flat upper surface having a same height as a height of the undermost portion of the upper surface 22*d* of the central portion 22*a*. And, the slit 22*c* has a thin bottom 22*g*.

As shown in FIG. 4A, in a free state in which the operation knob 6 is not applied with pressure, the under surface of the working portion 6*b* of the operation knob 6 contacts only the central portion 22*a*, specifically the edge 22*e* on the pivot point side, and does not contact the peripheral portion 22*b*. The operation knob 6 tilts upward from the pivot point P and contacts the push-button portion 22.

Referring to FIG. 5, a switching operation of the switch will be described.

In a preload state shown in FIG. 5A, as with FIG. 3A, the push-button portion 22 rotates around the edge 22*e* on the pivot point side clockwise in the figure. Since the slit 22*c* is formed between the central portion 22*a* and the peripheral portion 22*b*, the bottom 22*g* of the slit 22*c* is easily deformable. Accordingly, the central portion 22*a* is easily rotatable to the bottom 22*g* of the slit 22*c* clockwise in the figure. As a result, it becomes possible to contact the under surface of the operation knob 6 with the upper surface 22*d* of the central portion 22*a* and the upper surface of the peripheral portion 22*b* of the push-button portion 22 tightly. And, the movable contact 14 tilts downward toward the side of the pivot point P.

As shown in FIG. 5B, when the key top 5 is pushed down to push down the push-button portion 22 by the operation knob 6, the operation knob 6 rotates into a state tilted slightly downward with respect to the pivot point P. The movable contact 14 still tilts downward toward the side of the pivot point; however, an angle of the tilt with respect to a level line becomes smaller than the state shown in FIG. 5A.

Then, as shown in FIG. 5C, when the key top 5 is pushed down undermost to push down the push-button portion 12 by the operation knob 6, as with FIG. 3C, the movable contact 14 contacts the fixed contact 3 in a substantially level posture. At the same time, the skirt portion 13 is deformed, as with FIG. 3C.

When the push-button portion 22 is formed with the slit 22*c* like this embodiment, all area of the upper surface of the push-button portion 22 can contact the under surface of the working portion 6*b* of the operation knob 5. However, the slit 22*c* does not always have to be formed.

BRIEF DESCRIPTION OF THE DRAWINGS

FIG. 2 are views showing a structure of a contact rubber switch included in the switch of FIG. 1.

FIG. 4 are views showing a contact rubber switch included in a switch according to the second embodiment of the present invention.

EXPLANATION OF REFERENCES

Figure 1:
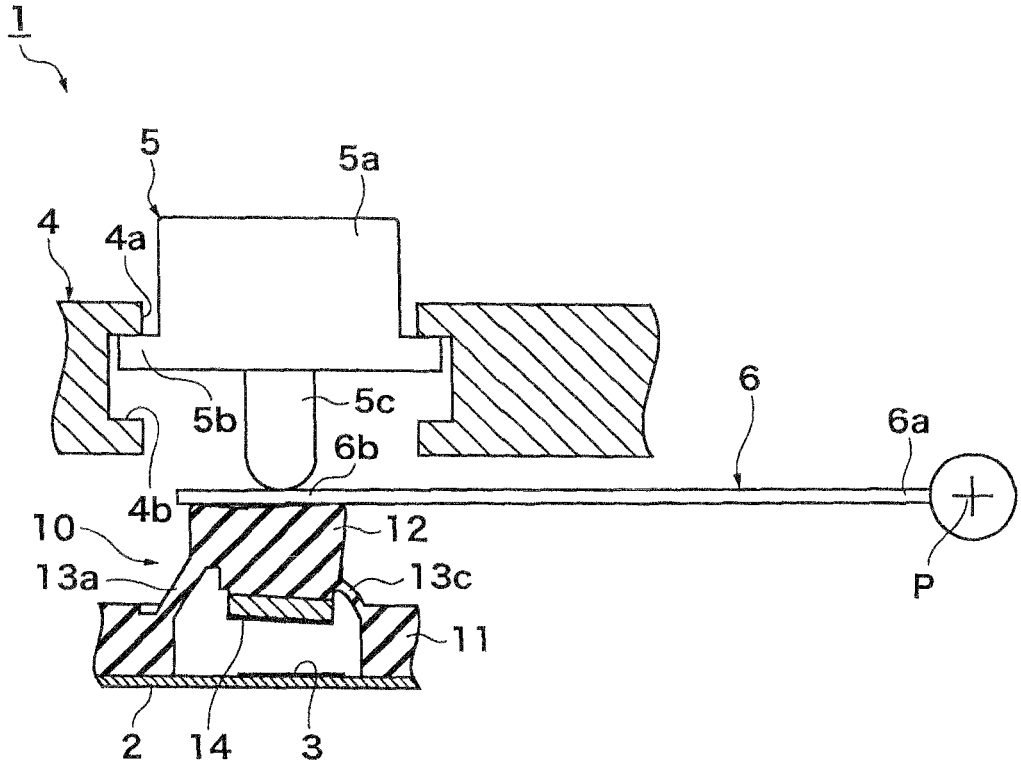
FIG. 1 is a side view showing a switch according to the first embodiment of the present invention.
Figure 2A:
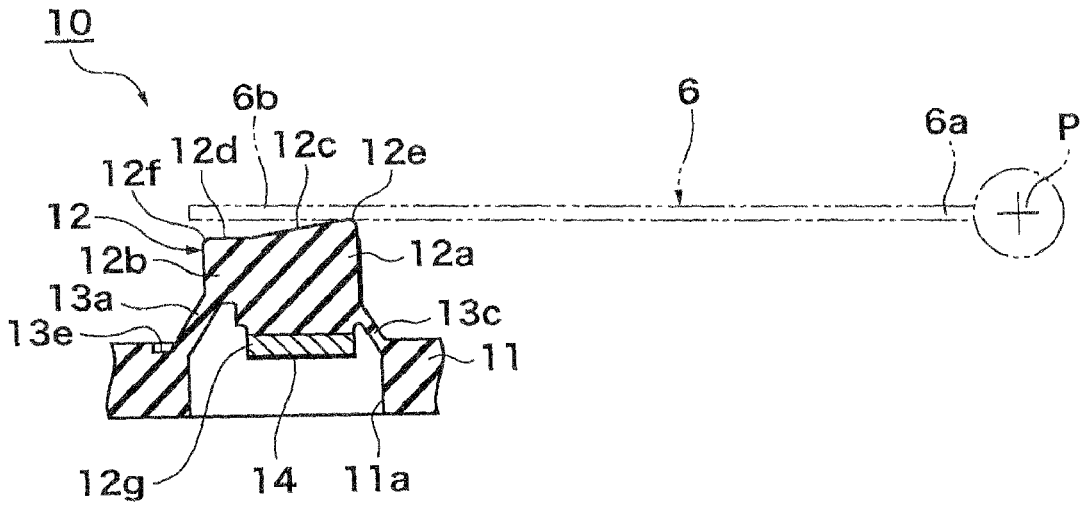
FIG. 2(A) is a side view and FIG. 2(B) is a plain view.
Figure 2B:
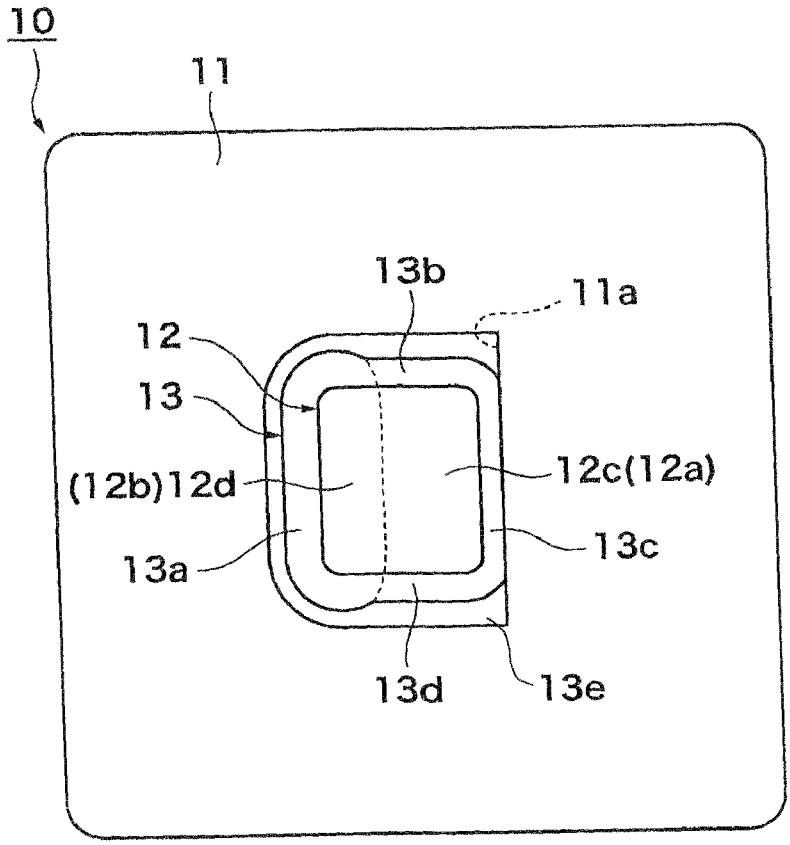
Figure 3A:
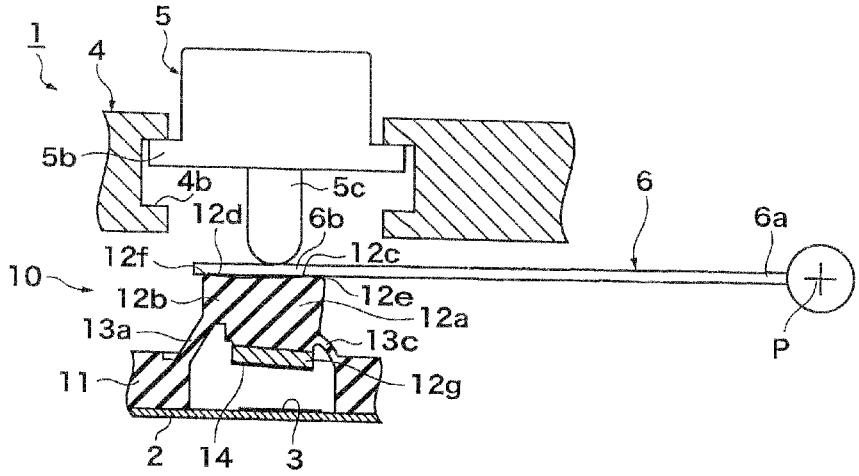
FIG. 3 are side views showing operating state of the switch of FIG. 1.
Figure 3B:
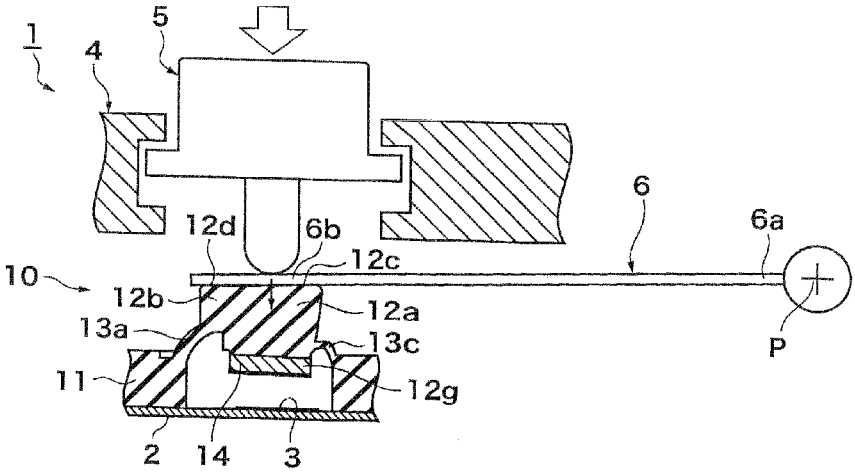
Figure 3C:
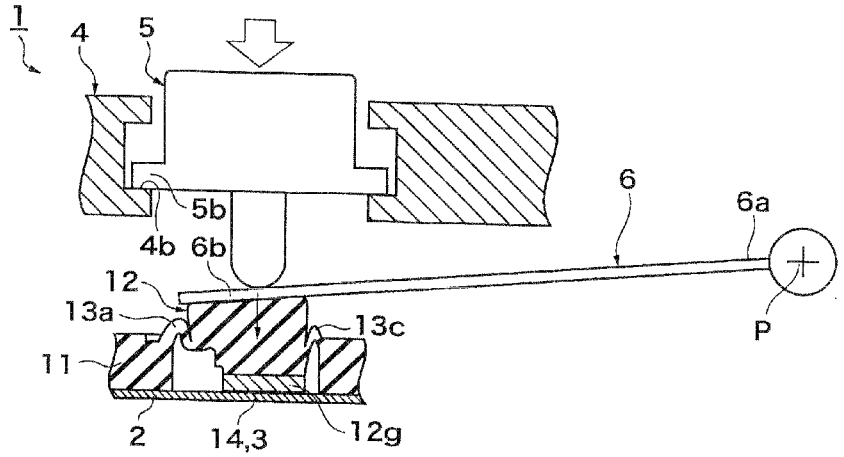
Figure 4A:
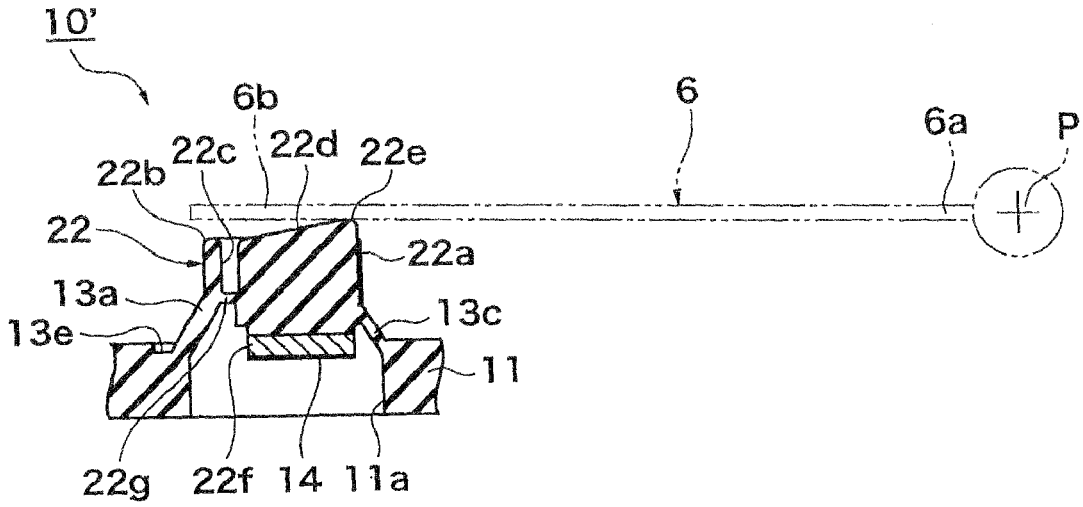
FIG. 4A is a side view and FIG. 4B is a plain view.
Figure 4B:
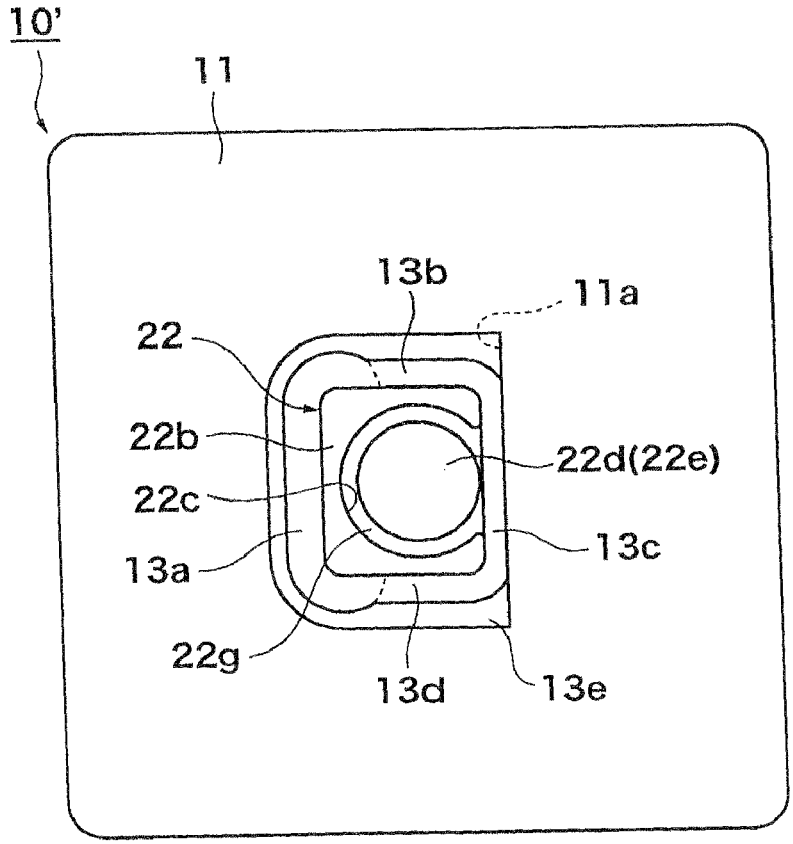
Figure 5A:
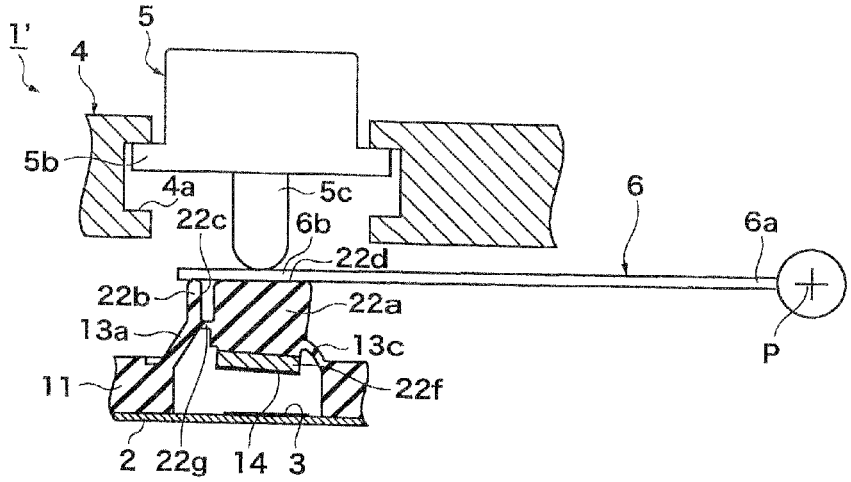
FIG. 5 are views showing operating state of the switch of FIG. 4.
Figure 5B:
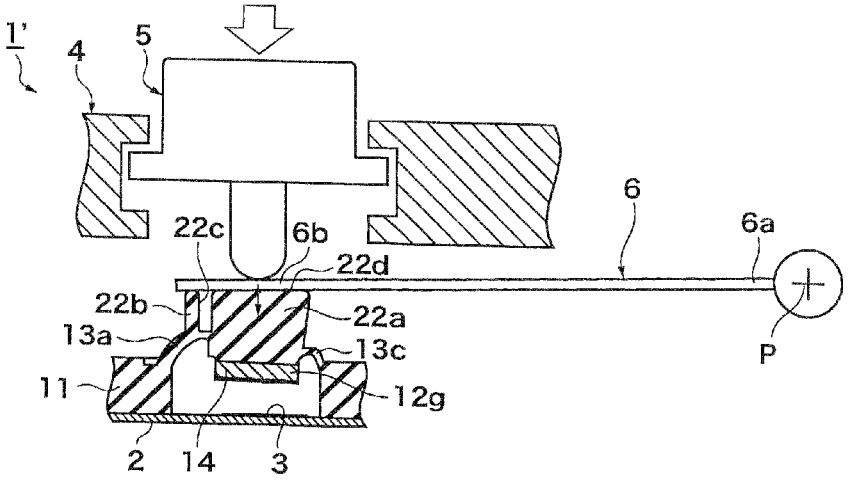
Figure 5C:
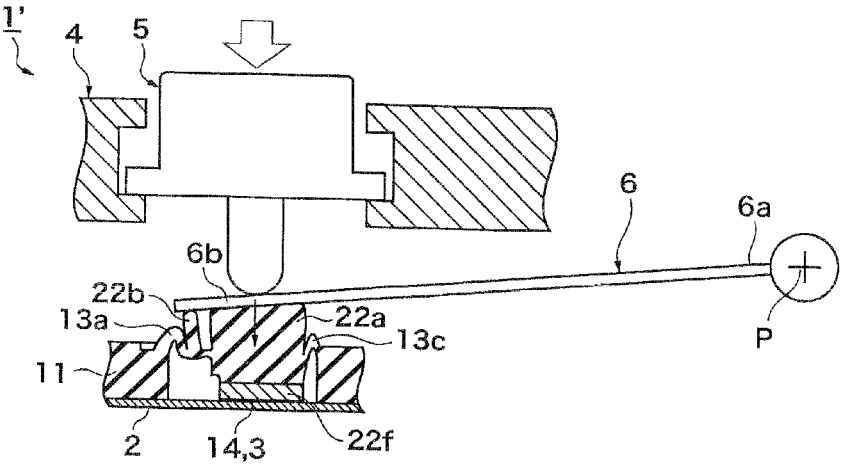

| | |
|---|---|
| 1 switch | 2 circuit board |
| 3 fixed contact | 4 case |
| 5 key top | 6 operation knob |
| 10, 10' contact rubber switch | |
| 11 supporting portion | 12, 22 push-button portion |
| 13 skirt portion | 14 movable contact |

What is claimed is:

1. A switch pushed down so as to conduct a fixed contact formed on a circuit board comprising:

a key top to be pushed down;

an operation knob pushed down by the key top to rotate around a pivot point, having a working portion; and a contact rubber switch pushed down by the working portion of the operation knob, wherein the rubber switch is provided with a push-button portion having an upper surface pushed down by the working portion of the operation knob and an under surface formed with a movable contact; and a skirt portion extending obliquely downward from an edge of the push-button portion, in which the skirt portion has a thinner portion on the side of the pivot point of the operation knob and a thicker portion on the opposite side of the pivot point of the operation knob and the push-button portion has an upper surface inclined upward toward the side of the pivot point of the operation knob, wherein the working portion of the operation knob contacts the edge of the push-button portion of the rubber switch, on the side of the pivot point of the operation knob, to deform the skirt portion on the side of the pivot point at the initial step of the push down operation, and then the working portion contacts the edge of the push-button portion of the rubber switch, on the opposite side of the pivot point, to be pushed down and to deform the skirt portion on the opposite side of the pivot point.

2. A switch according to claim 1, wherein the contact rubber switch is operated in such a manner that the movable contact tilts downward toward the side of the pivot point when the key top is being applied with preload;

an angle of the movable contact becomes small gradually during a push down operation of the key top; and the movable contact comes contact with the fixed contact with substantially a parallel posture at the final step of the push down operation.

3. A switch according to claim 1, wherein the thicker skirt portion on the opposite side of the pivot point of the operation knob is suddenly deformed at the final step of the push down operation to cause a click feeling teaching a completion of the push down operation to the user.

4. A switch pushed down so as to conduct a fixed contact formed on a circuit board comprising:

a key top to be pushed down;

an operation knob pushed down by the key top to rotate around a pivot point, having a working portion; and a contact rubber switch pushed down by the working portion of the operation knob, wherein the rubber switch is provided with a push-button portion having an upper surface pushed down by the working portion of the operation knob and an under surface formed with a movable contact; and a skirt portion extending obliquely downward from an edge of the push-button portion, in which the skirt portion has a thinner portion on the side of the pivot point of the operation knob and a thicker portion on the opposite side of the pivot point of the operation knob and the push-button portion has an upper surface inclined upward toward the side of the pivot point of the operation knob, wherein the push-button portion of the contact rubber switch has a central portion having a surface inclined upward toward the side of the pivot point;

a peripheral portion surrounding the central portion other than an edge on the pivot point side; and a slit having a thin base separating the central portion from the peripheral portion, in which the working portion of the operation knob contacts only the upper surface of the central portion and does not contact the peripheral portion when comes in contact with the push-button portion of the contact rubber switch.

5. A switch according to claim 4, wherein the contact rubber switch is operated in such a manner that the movable contact tilts downward toward the side of the pivot point when the key top is being applied with preload;

an angle of the movable contact becomes small gradually during a push down operation of the key top; and the movable contact comes contact with the fixed contact with substantially a parallel posture at the final step of the push down operation.

6. A switch according to claim 4, wherein the thicker skirt portion on the opposite side of the pivot point of the operation knob is suddenly deformed at the final step of the push down operation to cause a click feeling teaching a completion of the push down operation to the user.

* * * * *